United States Patent [19]

Masterson

[11] Patent Number: 4,863,104

[45] Date of Patent: Sep. 5, 1989

[54] SPRAY GUN APPARATUS

[75] Inventor: Jon A. Masterson, Long Beach, Calif.

[73] Assignee: Wallboard Tool Company, Inc., Long Beach, Calif.

[21] Appl. No.: 235,526

[22] Filed: Aug. 24, 1988

[51] Int. Cl.[4] ..... B05B 7/30

[52] U.S. Cl. ..... 239/345; 222/630; 239/346; 239/376; 239/390; 239/600; 406/38

[58] Field of Search ..... 239/308, 337, 345, 346, 239/369, 371, 375, 376, 390, 527, 600; 222/630; 406/38, 145, 153

[56] References Cited

U.S. PATENT DOCUMENTS

| | | | |
|---|---|---|---|
| 1,650,686 | 11/1927 | Binks | 239/527 |
| 2,305,269 | 12/1942 | Moreland | 239/345 |
| 2,887,274 | 5/1959 | Swenson | 239/371 |
| 3,236,459 | 2/1966 | McRitchie | 239/345 |
| 3,945,571 | 3/1976 | Rash | 239/375 |
| 4,364,521 | 12/1982 | Stankowitz | 239/346 |
| 4,438,884 | 3/1984 | O'Brien et al. | 239/600 |

FOREIGN PATENT DOCUMENTS

| | | | |
|---|---|---|---|
| 210449 | 2/1907 | Fed. Rep. of Germany | 239/345 |
| 2336186 | 7/1977 | France | 239/346 |

*Primary Examiner*—Andres Kashnikow
*Assistant Examiner*—Michael J. Forman
*Attorney, Agent, or Firm*—Fulwider, Patton Rieber, Lee & Utecht

[57] ABSTRACT

An apparatus for spraying liquidous mixtures via compressed air is described. The design allows extensive use of plastic in its construction, employs a minimum of parts and allows complete assembly and reassembly with only a minimum of hand tools. The device incorporates an automatic air shut off valve that stops the flow of air upon release of the trigger, an adjustable trigger stop that ensures a uniform flow rate and a special orifice plate design that enables its quick replacement.

8 Claims, 2 Drawing Sheets

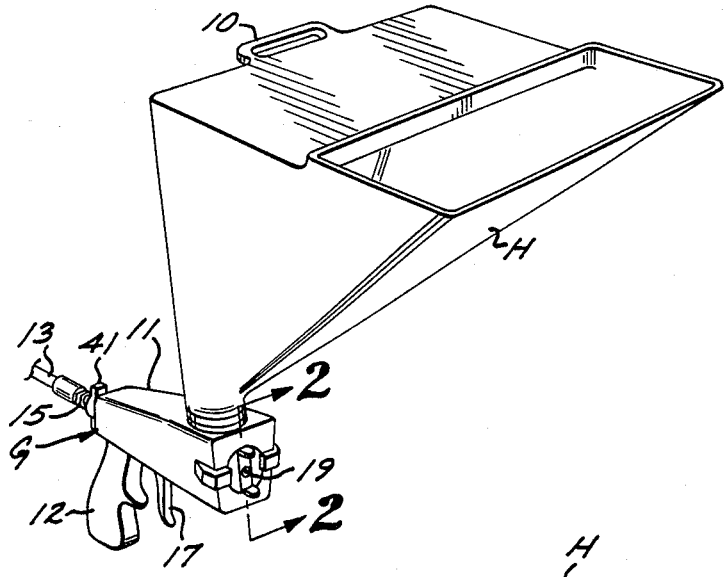
FIG. 1
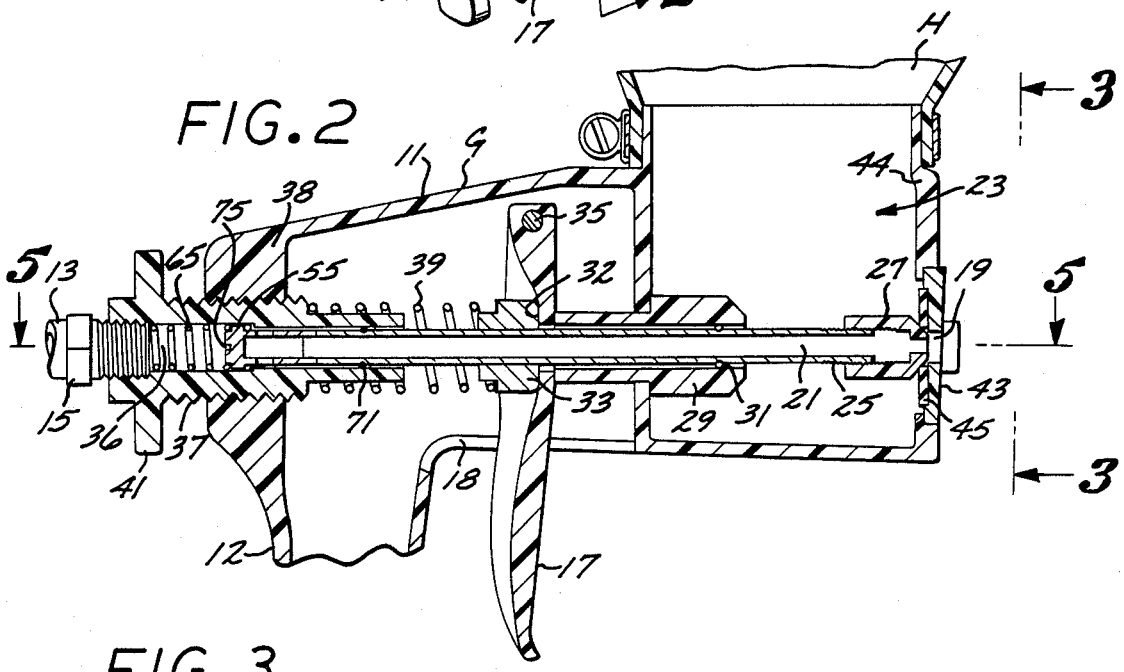
FIG. 2
FIG. 3
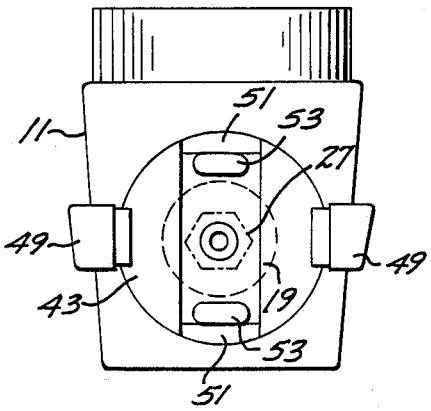
FIG. 4
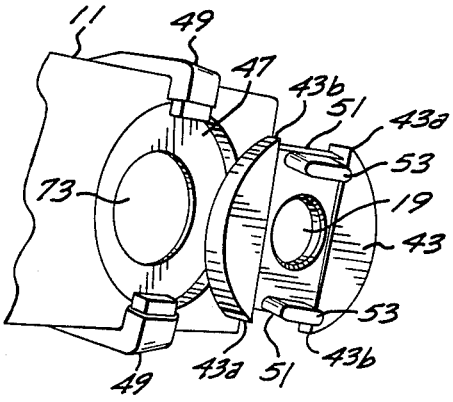

SPRAY GUN APPARATUS

BACKGROUND OF THE INVENTION

The present invention relates to a spraying apparatus and more particularly to an improved spray gun adapted for spraying liquidous mixtures such as cementitious slurries, ceiling acoustic or wall texture by means of compressed air.

The speed and convenience as well as the quality of the work product afforded by the application of such mixtures by spraying has generally caused more laborious manual methods to be supplanted. Furthermore, the use of compressed air to propel or carry the mixtures is of proven efficiency and is particularly convenient due to the ready availability of a compressed air supply at most job sites.

The function and operation of typical spray gun designs involves the gradual introduction of the material to be sprayed into a stream of fast moving air. A characteristic design is illustrated in Roche U.S. Pat. No. 3,003,704 and McRitchie U.S. Pat. No. 3,236,459 where material drains from the device through an orifice centered about a nozzle emitting a jet of air. Contact with the jet causes the escaping material to be accelerated and transported towards the target surface. A variation of this design is illustrated in Roche U.S. Pat. No. 2,656,217 wherein the material issues from a nozzle centrally disposed within a stream of air. The air pressure, air volume, orifice size, nozzle shape and diameter and the location of the orifice relative to the nozzle are all factors that intimately effect the spray pattern and volume of the material issuing from the spray gun, as well as the coverage rate and texture of the resulting work product.

Many of the disadvantages associated with the prior art spraying devices are inherent in their typically complex designs and constructions. A device that relies on the interaction of a multitude of intricate parts in intricate configurations is initially expensive, is susceptible to failure or gradual deterioration in performance, and eventually requires costly or time consuming repairs. A further disadvantage of some prior art spraying devices is that the interior or a portion of the interior of the spray gun body is subjected to the force of the pressurized air. This limits the types of materials that can be used in the spray gun body's construction, requires either a precise casting or machining of the gun body and requires the utilization of extra seals and/or gaskets in its assembly.

SUMMARY OF THE INVENTION

An object of the present invention is to provide a spray gun of simple and robust design utilizing a minimum of parts.

Another object of the invention is to provide a spray gun that allows quick and easy disassembly and reassembly for purposes of cleaning and or repair.

A further object of the invention is that the spray gun design be resistant to the development of leaks and resistant to internal contamination.

An advantage of the present invention is that the spray gun design lends itself to the extensive use of plastics in its construction. In particular, no portion of the spray gun body is subject to the force of the pressurized air and further a minimum of threaded connections is employed throughout the design.

A further object of the invention is that in spite of the above-cited design constraints, the spray gun incorporates a number of convenient features including a trigger-activated air shut-off air valve, a simple and positive adjustment mechanism to set maximum material flow rates and a simple design that allows very quick interchanging of orifice sizes.

The foregoing and other objects are attained by the spraying apparatus of the present invention. The spray gun incorporates a trigger-activated air valve that automatically shuts off air flow upon release of the trigger thereby obviating the need for any extra movement or activation of external valves to shut off the flow of air. Air flowing from the nozzle accelerates material through an orifice located within an interchangeable orifice plate designed to allow quick and easy changes of orifice sizes; simple insertion of the orifice plate into a depression at the front of the spray gun body and a twist positively locks the orifice plate into place. The maximum rate of material flow is precisely and repeatably limited by an adjusting mechanism with which the maximum separation of the air nozzle from the orifice is set. Simply twisting a large diameter set screw at the rear of the spraying achieves the adjustment. All necessary sealing in and around the moving parts of the spray gun is achieved by means of O-rings. No other packings, gaskets or washers are required.

The unique orifice plate mount and the use of only one large diameter threaded interface in the spray gun body greatly minimizes the tensile loads to which the spray gun body is subjected. In addition, the spray gun body itself is not subjected to the force of the compressed air. These design features allow the extensive use of plastic throughout the spray gun body's construction and permit a simple assembly with adhesives, without the need for gaskets, seals or fasteners. A spray gun embodying the present invention therefore provides a simple, inexpensive, reliable and lightweight device.

BRIEF DESCRIPTION OF THE DRAWINGS

Other objects and many of the attendant advantages of this invention will be readily appreciated as the same becomes better understood by reference to the following detailed description, when considered in conjunction with the accompanying drawings in which like reference numerals designate like parts throughout the figures thereof and wherein:

FIG. 1 is a perspective view of a spray gun and hopper embodying the present invention;

FIG. 2 is a vertical sectional view of the spray gun taken in enlarged scale substantially along lines 2—2 of FIG. 1;

FIG. 3 is an enlarged front elevational view of the spray gun;

FIG. 4 is an exploded perspective view of the parts shown in FIG. 3;

DETAILED DESCRIPTION OF THE PREFERRED EMBODIMENT

Figure 5:
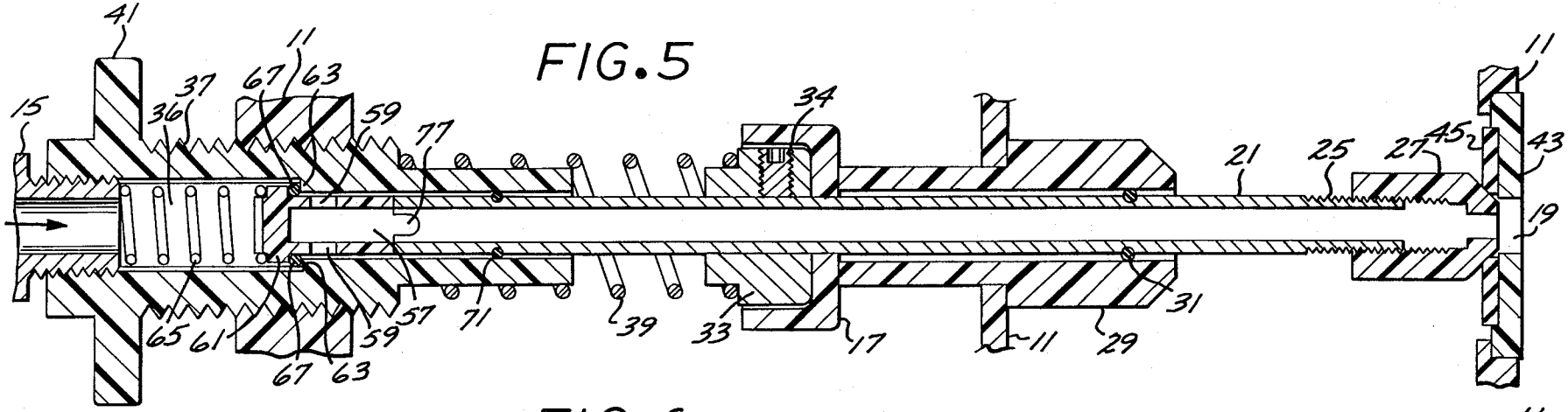
FIG. 5 is a horizontal sectional view of an tubular air-transfer plunger assembly of said spray gun in its closed position taken in further enlarged scale along lines 5—5 of FIG. 2.

FIG. 1 generally illustrates a preferred form of spray gun apparatus embodying the present invention. A conventional liquidous mixture hopper H having a handle 10 is attached to the top of a spray gun, generally designated G. Spray gun 11 receives a pressurized air supply by means of a hose 13 connected to fitting 15 at the rear of the spray gun body, and upon depression of trigger 17, material from the hopper is emitted through orifice 19 disposed at the front end of the body. A pistol grip-type handle 12 integral with spray gun body 11 is used by an operator (not shown) to manipulate the spray gun G. With a firm grasp of both the hopper handle 10 and the spray gun handle 12, the operator can guide the device and control the spray pattern of the material by depressing the trigger 17. The spray gun apparatus suited for applying for example, acoustic material to ceilings or wall texture to vertical surfaces.

Figure 6:
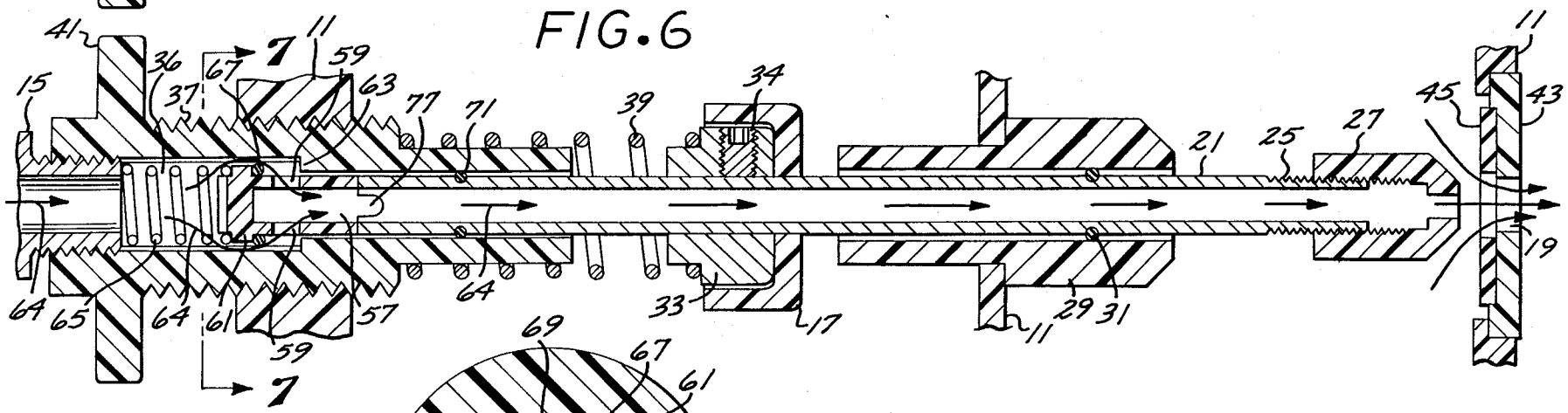
FIG. 6 is a horizontal sectional view of the parts shown in of FIG. 5 arranged in a partially open position.

FIG. 2 is a detailed vertical sectional illustration of the spray gun's internal mechanism. An tubular air-transfer plunger 21 extends through the center of a supply chamber 23 formed at the front of the spray gun and disposed below hopper H. The plunger has a threaded end 25 to which is affixed a threaded nozzle 27. The high velocity flow of pressurized air through the nozzle eventually causes it to wear and consequently, the nozzle requires periodic replacement. The nozzle is preferably hexagonal in shape (see FIG. 3) to facilitate its removal and replacement with conventional tools. The plunger 21 is radially positioned via the plunger guide 29 which is rigidly affixed to the interior of the spray gun body. An O-ring 31 positioned within a groove in the plunger effectively forms a seal to prevent material from leaking out of the chamber 23 through the space between the plunger 21 and the plunger guide 29. The plunger collar 33 is rigidly affixed to the plunger by a set screw 34 (FIG. 5 and FIG. 6). The trigger 17 is pivotally affixed to the body 11 at 35 and extends downwardly out of the body through body slot 18, with its intermediate portion 32 engaging the plunger collar 33 to effect retraction of the plunger 21 by rearward depression of the trigger. A hollow plunger stop 37 capable of receiving the rear of the tubular air-transfer plunger 21 is threaded into the rear wall 38 of the spray gun body 11. A coil spring 39 coaxially disposed about the plunger 21 and stop 37 and compressed between the stop 37 and collar 33 biases the plunger 21 and hence the trigger towards the front of the spray gun. The amount of travel of the plunger is limited by contact of the collar 33 with the stop 37. Consequently, twisting the stop into or out of the spray gun body adjusts the maximum distance the plunger can be retracted. Wings 41 radially extending from the stop 37 facilitate rotation of the stop.

As mentioned above, the tubular air-transfer plunger 21 and nozzle 27 are biased towards the front of the spray gun with the nozzle sealingly contacting a gasket or washer 45 affixed to the rear of the plate. It is desirable to be able to quickly and easily change orifice plates 43, as either a different size orifice may be required for a particular job, or the existing orifice and washer may have eroded with use. The exterior of the front wall 44 of the spray gun has a circular depression 47 formed therein capable of removably receiving the orifice plate. In addition, two retainers 49 are disposed at the edges of the depression and extend towards its center, as shown in FIGS. 3 and 4. Two corresponding notches 51 in the orifice plate allow insertion of the orifice plate 43 into the depression 47. Once positioned in depression 47, the orifice plate is twisted whereupon the cammed surface of the plate (**43*a* is thicker than 43*b*) engages the overhanging retainers 49 and positively wedges the plate into place. The two studs 53 formed on the exterior face of the orifice plate 43** aid in the rotation and tightening of the plate.

Figure 7:
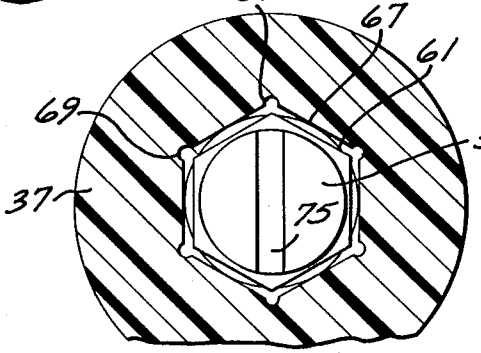
FIG. 7 is a vertical sectional view of the air valve taken along the lines 7—7 of FIG. 6.

FIGS. 5 and 6 illustrate the design and function of the trigger actuated air valve mechanism. A generally cylindrical valve member 55 is slideably disposed within the coaxial air passage 36 of plunger stop 37. The valve member 55 has a hollow portion 57 communicating with its exterior by means of a pair of transverse holes 59. An enlarged valve head 61 on the rear of valve 55 is normally biased against valve seat 63, formed in the interior of the trigger stop, by coil spring 65 to provide an effective seal utilizing an O-ring 67. In this position, the flow of compressed air from fitting 15 is shut off. Upon rearward movement of the trigger 17, the plunger 21 is urged against the front of valve member 55 and overcomes the force of spring 65 thereby lifting the valve head 67 off the valve seat 63 to allow passage of the compressed air. The configuration of the valve head 61 and the interior of the trigger stop 37 is such (FIG. 7) so as to allow the flow of air around the valve head near the apexes of its hexagonal geometry. Once around the valve head, the air flow proceeds through the holes 59 to the interior 57 of the valve member and to the nozzle 27, as indicated by the arrows 64 in FIG. 6. Another O-ring 71 seals the plunger 21 within the plunger stop 37 and prevents air pressure from being lost into the interior of the spray gun. In fact, no part of the spray gun body is subjected to super-atmospheric conditions. Only the interior of the trigger stop and the tubular air-transfer plunger are exposed to elevated air pressure.

The design of the orifice plate mounting, the simplicity of the entire actuation mechanism and the incorporation of only a single relatively large diameter threaded interface within the spray gun body allows the extensive use of synthetic plastics throughout the spray gun's construction. By way of example, polyethylene plastic is a viable construction material for the spray gun body 11, the plunger stop 37, the valve member 55, the trigger 17 and plunger guide 29 as well as the orifice plate 43 and retainers 49. The spray gun body incorporating the retainers 49 may be injection molded in two halves which are simply glued together. Attachment of the plunger guide 29 to the joined body halves is similarly accomplished by means of a suitable adhesive.

In the operation of the afore described spray gun apparatus, upon loading of the hopper 13 with the liquidous mixture material to be sprayed, the material fills the supply chamber 23 below. An compressed air supply is connected to the rear of spray gun G via fitting 15 and the apparatus is ready to be used. Prior to depression of the trigger, neither air nor spray material issues from the orifice. Spring 39 urges the nozzle 27 against gasket 45 to seal the chamber and spring 65, as well as the air pressure itself urges the valve head 61 against the O-ring 67 and valve seat 63 to prevent the flow of air through the tubular air transfer plunger. Upon depression of the trigger, the plunger 21 and nozzle 27 are retracted from their normal position against the orifice gasket 45 allowing material to gravity feed through the orifice 19. The same trigger movement lifts the valve head 61 off its seat 63 to allow compressed air to flow past the valve member into the tubular air-transfer plunger and out through the nozzle. When the spray material flowing towards and out the orifice contacts the flow of air, the material is accelerated and carried towards the target surface. The further rearward the trigger is depressed, the greater the gap between the nozzle 27 and the orifice plate 43 thereby allowing more material to issue from the spray gun. Once a desired rate of flow has been achieved the trigger stop 37 is rotated to a position where it engages the collar thereby enabling the identical position of the trigger 17 to be attained every time the trigger is depressed. This ensures a uniform coverage rate through an entire job. A precisely repeatable trigger position assures that a precisely repeatable flow rate is achieved. Every time the trigger 17 is released the air flow, as well as the material flow, is immediately and completely shut off.

Complete field maintenance of the aforedescribed apparatus is easily accomplished with a minimum of tools. Exchange of orifice plates 43 only requires a manual twisting of the studs 53. Should the nozzle 27 require replacement, both orifice plate 43 and fitting 15 are removed. A socket-type tool can be inserted through the discharge opening 73 to engage the nozzle, while rotation of the plunger 21 is prevented by insertion of a screw driver into the trigger stop 37 to engage the slot 75 atop the valve head 61 of valve member 55. A force imparted by the screw driver is transmitted from the valve member 55 to the plunger 21 by the complementing coupling configuration 77 at their interface. Should leakage indicate wear of either O-ring 31 or O-ring 71, the entire valve and plunger assembly can be extracted from the rear of the spray gun by completely unscrewing trigger stop 37, extracting the tubular air-transfer plunger and slipping new O-rings into their respective grooves.

Various modifications and changes may be made with respect to the foregoing detailed description without departing form the scope of the present invention.

What is claimed:

1. Compressed air spray gun apparatus for spraying liquidous mixtures, said apparatus, comprising:

a spray gun body having a supply chamber at its front portion in communication with a discharge orifice formed in the front of said body;

a tubular air-transfer plunger longitudinally slidably supported within said body and formed at its front end with a nozzle that normally sealingly engages said discharge orifice within the supply chamber;

a hollow plunger stop formed with a coaxial air passage coaxially slidably carrying the rear portion of said plunger, the rear of said air passage defining a cylinder, said plunger stop being longitudinally adjustable relative to said body;

spring means interposed between said plunger and said plunger stop biasing said plunger forwardly;

a trigger movably mounted on said body;

a collar secured t the intermediate portion of said plunger and engageable with said trigger whereby rearward movement of said trigger effects rearward movement of said plunger nozzle away from said discharge orifice;

attachment means on said plunger stop connecting the air passage thereof with a compressed air source;

a normally closed air valve mechanism disposed in said coaxial air passage and having a valve head carried in said cylinder, with rearward movement of said trigger urging said valve head to an open position and said nozzle away from said discharge orifice whereby compressed air will flow forwardly through said plunger to thereby force material from said supply chamber through said discharge orifice.

2. The spray gun apparatus of claim 1 further comprising sealing means to normally constrain the flow of compressed air to the interior of the plunger stop and the plunger.

3. The spray gun apparatus of claim 2 wherein the sealing means includes an O-ring residing in a groove located in a section of the plunger slideably disposed within the plunger stop.

4. The spray gun apparatus of claim 2 wherein the discharge orifice is formed in an orifice plate replaceably attached to the front of the spray gun body.

5. The spray gun apparatus of claim 4 wherein the sealing means includes an O-ring residing in a groove located in a section of the plunger slideably disposed within the plunger stop.

6. The spray gun apparatus of claim 5 wherein a circular depression surrounds the discharge opening on the exterior surface of the spray gun body and two opposing projections extend from the spray gun body towards one another over said depression, and the replaceable orifice plate comprises a circular disc with the orifice in its center and with a notched edge of gradually increasing thickness as measured when proceeding from one notch to the next, whereby the notched configuration allows unhindered placement of the orifice plate into the depression and the increasing thickness of edges serve to wedgeably engage the projections upon a slight subsequent rotation of the orifice plate.

7. The spray gun apparatus of claim 1 wherein the discharge orifice is formed in a replaceable orifice plate replaceably attached to the front of the spray gun body.

8. The spray gun apparatus of claim 7 wherein a circular depression surrounds the discharge opening on the exterior surface of the spray gun body and two opposing projections extend from the spray gun body towards one another over said depression, and the replaceable orifice plate comprises a circular disc with the orifice in its center and with a notched edge of gradually increasing thickness as measured when proceeding from one notch to the next, whereby the notched configuration allows unhindered placement of the orifice plate into the depression and the increasing thickness of the edges serve to wedgeably engage the projections upon a slight subsequent rotation of the orifice plate.

* * * * *